United States Patent [19]

Cestari

[11] Patent Number: 5,077,650

[45] Date of Patent: Dec. 31, 1991

[54] MOUNTING SYSTEM FOR RECESSED LIGHTING FIXTURES

[76] Inventor: Frank Cestari, 2709 Morton Ave., Oceanside, N.Y. 11572

[21] Appl. No.: 606,515

[22] Filed: Oct. 31, 1990

[51] Int. Cl.[5] ..... F21S 1/02

[52] U.S. Cl. ..... 362/365; 362/147; 362/368

[58] Field of Search ..... 362/147, 149, 150, 364, 362/365, 366, 368, 370, 371, 404, 457

[56] References Cited

U.S. PATENT DOCUMENTS

| | | | |
|---|---|---|---|
| 2,518,936 | 8/1950 | Roberts | 362/364 |
| 2,744,716 | 5/1956 | Zingone | 362/147 |
| 2,914,287 | 11/1959 | Henning | 248/343 |
| 3,348,465 | 10/1967 | Kruger | 362/147 |
| 3,755,667 | 8/1973 | Price | 362/364 |
| 3,872,296 | 3/1975 | Cohen et al. | 362/366 |
| 4,048,491 | 9/1977 | Wessman | 362/364 |
| 4,250,540 | 2/1981 | Kristofek | 362/368 |
| 4,293,895 | 10/1981 | Kristofek | 362/147 |
| 4,306,279 | 12/1981 | Cohen | 362/365 |
| 4,420,802 | 12/1983 | Smester et al. | 362/364 |
| 4,424,554 | 1/1984 | Woloski et al. | 362/365 |
| 4,636,924 | 1/1987 | Targetti | 362/365 |
| 4,673,149 | 6/1987 | Grote et al. | 362/366 |
| 4,733,339 | 3/1988 | Kelsall | 362/366 |
| 4,739,460 | 4/1988 | Kelsall | 362/365 |
| 4,760,510 | 7/1988 | Lahti | 362/365 |

*Primary Examiner*—Ira S. Lazarus
*Assistant Examiner*—Sue Hagarman
*Attorney, Agent, or Firm*—Dilworth & Barrese

[57] ABSTRACT

An apparatus for mounting an electrical fixture to a support member includes a fastening member which is pivotally mounted within the housing of the fixture and extends through the housing. Deployment structure, such as a spring, causes a portion of the fastening member located outside of the housing to extend over the support member. Structure within the housing allows movement of the fastening member into contact with the support member to secure the fixture to the support member. Preferably, the mounting system includes a plurality of fastening members which can be moved into contact with the support member.

5 Claims, 2 Drawing Sheets

MOUNTING SYSTEM FOR RECESSED LIGHTING FIXTURES

FIELD OF THE INVENTION

This invention relates to recessed electrical fixtures. More particularly, this invention relates to systems for mounting recessed electrical fixtures, such as, for example, recessed lighting fixtures.

BACKGROUND OF THE INVENTION

Recessed electrical fixtures typically include a housing which may be box-like or cylindrical and is open at one end. In a remodeling situation, a hole, approximately the same size and shape of the housing, is cut in a support member, such as a wall or ceiling, and the housing of the electrical fixture is inserted therein. A flange or lip which is generally perpendicular to the walls of the housing, extends beyond the walls of the housing and prevents the fixture from passing completely through the opening. Retaining the fixture within the hole is somewhat problematic, since the topside of the ceiling, or inside of the wall, is inaccessible once the housing is placed therein. Additionally, the thickness of the ceiling or walls may vary and the mounting system must be able to accommodate such variations. Also, when recessed fixtures are mounted into a ceiling, installation is usually performed on a ladder and can be quite dangerous if the mounting system is complex to use or requires the use of two hands for extended periods of time.

Known mounting systems for recessed lighting fixtures include springs or clips which engage the ceiling or wall support member to retain the fixture in place. See U.S. Pat. Nos. 4,733,339 and 4,739,460 both to Kelsall and U.S. Pat. No. 4,760,510 to Lahti. Clips are also used in conjunction with a "plaster frame" in a new construction situation to mount recessed fixtures in U.S. Pat. No. 4,293,895 to Kristofek U.S. Pat. No. 2,518,936 employs a sleeve or band which is first secured to the ceiling, and to which the lighting fixture is then secured. Systems for mounting recessed lighting fixtures in a suspended ceiling are also known. See U.S. Pat. No. 3,755,667 to Price and U.S. Pat. No. 4,424,554 to Woloski, et al.

Mounting systems which use retractable fastening members which are lowered to engage the upper or inside surface of the support member are described in U.S. Pat. No. 4,048,491 to Wessman and U.S. Pat. No. 2,914,287 to Henning. A major drawback to the mounting systems in both Wessman and Henning is that the retractable members must be extended or retracted one at a time. This requires the installer to use both hands (one to support the fixture and one to extend each fastening member individually) for an extended period of time before the fixture will be even loosely retained within the hole in the support member. This increases the likelihood of injury to an installer working on a ladder since the installer cannot hold on to the ladder during the installation. The Wessman system has the further drawback of having the screws used to adjust the position of the fastening members located on the outside of the fixture. This requires either an odd-shaped hole be cut in the support member or more precision in the cutting of a circular hole in the support member.

OBJECTS OF THE INVENTION

It is therefore an object of this invention to provide a simple mounting system for a recessed electrical fixture which allows for quick and easy installation of the fixture.

It is also an object of this invention to provide a mounting system for a recessed electrical fixture which allows installation of the fixture to be completed in large part using only one hand.

It is therefore a further object of this invention to provide a mounting system for a recessed electrical fixture which is safer to use than previously known mounting systems since the installer can keep one hand on the ladder during most of the installation.

These and other advantages of the mounting system of the present invention will be apparent to those skilled in the art from the description of the invention which follows.

SUMMARY OF THE INVENTION

The mounting system of the present invention includes: a fastening member which extends through a slot in the housing of the fixture such that a portion of the fastening member is located within the housing and a portion of the fastening member is located outside of the housing; means for cooperating with the threads of a screw (preferably a nut) mounted on the portion of the fastening member located within the housing; a screw pivotally mounted within the housing and passing through the nut mounted on the fastening member such that rotation of the screw causes vertical adjustment of the fastening member either into or out of contact with the support member; spring means for urging the portion of the fastening member located outside of the housing away from the housing so that the fastening member extends beyond the flange at the bottom of the housing; and retaining means for keeping the portion of the fastening member located outside of the housing sufficiently close to the housing so that the fastening member does not extend beyond the flange of the housing. Preferably, the mounting system includes a plurality of fastening members which can be lowered into contact with the support member. In addition, removal of the retaining means in the preferred embodiment causes simultaneous extension of all of the fastening members beyond the flange of the housing.

DESCRIPTION OF PREFERRED EMBODIMENTS

Figure 1:
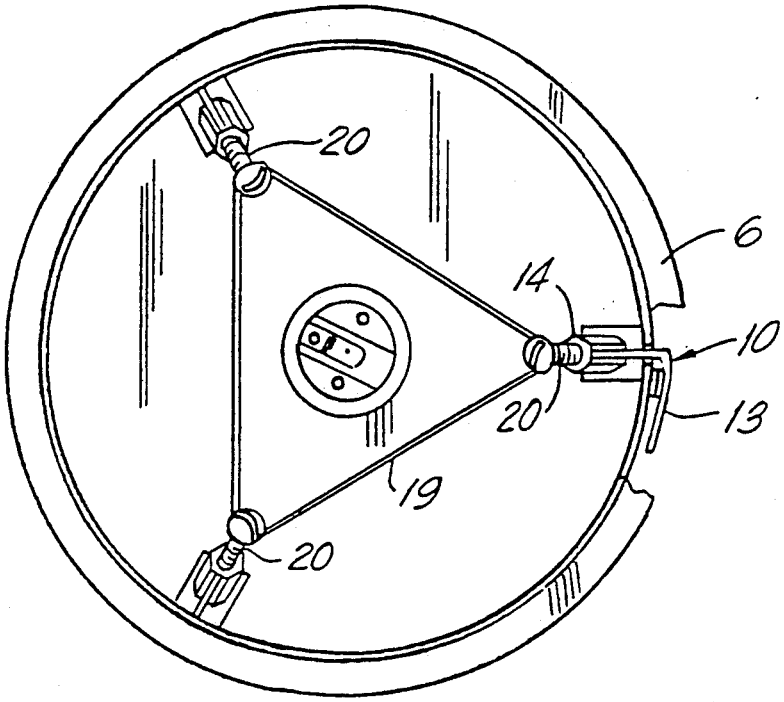
FIG. 1 is a bottom view of the fixture with the fastening members in the retracted position.

Referring now to FIG. 1, a recessed lighting fixture includes a generally cylindrical housing 5 having a flange 6 at the open end thereof. While the present invention will be described for a lighting fixture having a cylindrical housing, it should be understood that the mounting system of the present invention can be used with a wide variety of electrical fixtures of various shapes. Additionally, while the present invention will be described with regard to installation into a ceiling, it should be understood that the fixture may also be mounted to support members having other orientations, such as, for example a vertical support member (i.e., a wall). For purposes of describing the present invention, the open end of the fixture will be considered the bottom of the fixture.

Fastening member 10 extends through slot 7 in housing 5 such that one portion 11 of fastening member 10 is located within the housing 5 and the other portion 12 is located outside of housing 5. Preferably, portion 12 of fastening member 10 includes a portion 13 which is bent at an angle to portion 11. Most preferably, portion 13 of fastening member 10 is bent to match the contour of the housing 5. Means for cooperating with the threads of a screw, preferably a nut 14, is mounted, for example by welding, to portion 11 of fastening member 10. Screw 20, which is threaded through nut 13, is positioned with its head downward, i.e., with its head toward the open end of the housing 5. Screw 20 is pivotally mounted within the housing 5 and in such a way that it is free to rotate. Since screw 20 passes through nut 14 the direction of the pivotal motion of screw 20 is limited by the passage of fastening member 10 through slot 7 in the housing 5. Thus, screw 20 can only pivot essentially toward and away from the housing 5.

In a preferred embodiment, end 21 of screw 20 passes through bracket 16 and is retained therein by retaining means 17. Bracket 16 may be mounted to the housing 5, but is preferably punched out of the housing material itself. The threads on end 21 of screw 20 are preferably removed, so that while end 21 passes through bracket 16, the remaining threads of screw 20 will contact bracket 16. Screw 20 thus will be essentially fixed with regard to its vertical position since the hole in bracket 16 is smaller in diameter than the remaining threads on screw 20, but larger than the diameter of end 21 which has had the threads machined off. Any means which prevents withdrawal of screw 20 from bracket 16 but which does not inhibit rotationof screw 20 can serve as the retaining means 17. Thus, retaining means 17 may be a frictional or press-fit washer, clip, hub or cap. Alternatively, the retaining means may simply be formed by flattening end 21 of screw 20 once it is positioned through bracket 16.

Figure 2:
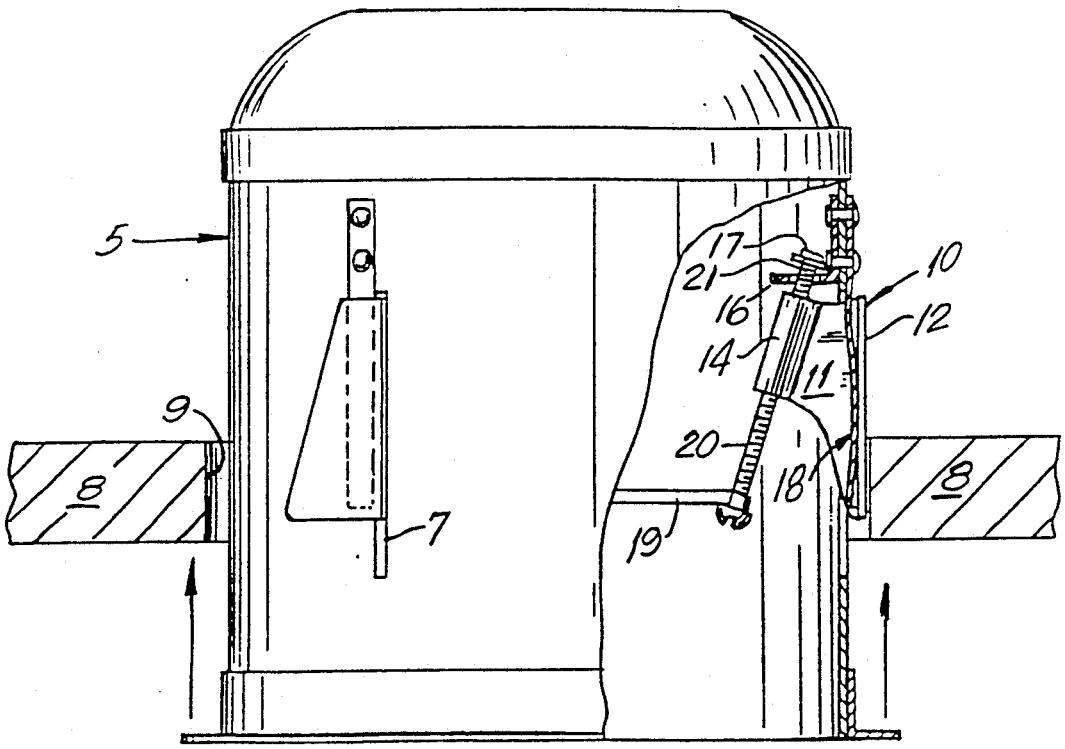
FIG. 2 is an elevational view, partly in cross-section, showing the fastening members in the retracted position.
Figure 3:
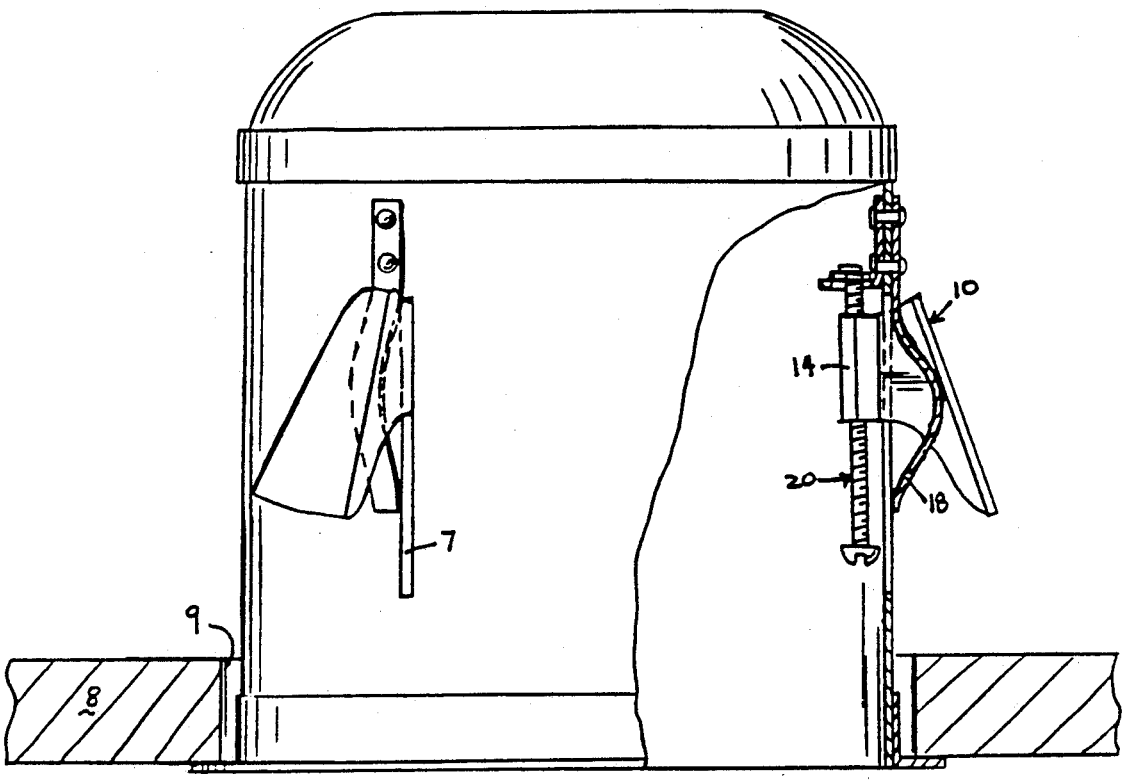
FIG. 3 is an elevational view, partly in cross-section, showing the fastening members in the extended position.
Figure 4:
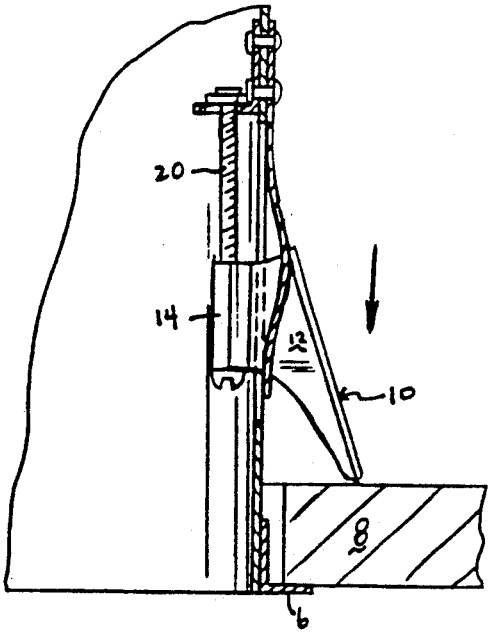
FIG. 4 is a fragmentary cross-sectional view showing the fastening member in the extended position and lowered into contact with the support member.

Spring means 18 may be mounted to housing 5 as shown or formed directly out of the material of the housing. Spring means 18 urges portion 13 of fastening member 10 away from housing 5 and, since screw 20 passes through nut 14, causes screw 20 to pivot toward the housing 5. Spring means 18 may be compressed by manually pivoting screw 20 away from the housing 5. When screw 20 is pivoted away from the housing 5 sufficiently that portion 13 of fastening member 10 does not extend beyond flange 6, fastening member 10 is in the retracted position as shown in FIGS. 1 and 2. When screw 20 is released and portion 13 of fastening member 10 extends beyond flange 6, fastening member 10 is in the extended position as shown in FIGS. 3 and 4.

While the screws 20 could be manually held at the center of the housing thereby keeping the fastening members 10 in the retracted position, preferably a retaining means maintains fastening members 10 in the retracted position. The retaining means may be a clip, strut, block of material or other propping device to keep screw 20 in a position away from housing 5. Preferably, as shown in FIG. 1 the retaining means may be a rubber band 19 or a "twist-tie" capable of maintaining all fastening members in the retracted position simultaneously. Thus, removal of rubber band 19 will cause simultaneous extension of all fastening members 10 in the most preferred embodiment.

To install a lighting fixture using the mounting system of the present invention a hole 9 is first cut in the ceiling 8. The hole 9 should be of a diameter greater than the diameter of the housing, but less than the diameter of the flange 6 so that the housing may be slid into the hole but the flange will prevent the fixture from passing completely into the ceiling.

The fastening members 10 are then all placed in the retracted position by manually pivoting screws 20 toward the center of the housing 5 and rubber band 19 is placed around screws 20 as shown in FIG. 1.

The fixture is then inserted into hole 9 until the lower end of fastening members 10 are above the ceiling. Rubberband 19 is then removed causing the fastening members to essentially simultaneously move into the extended position as shown in FIG. 3. The simple, single step of removing the rubberband 19 allows the fixture to now be loosely retained within the ceiling without the need for support by the installer. Since the fixture need no longer be supported by the installer, the installer can now complete the final steps in the installation with one hand.

To firmly secure the fixture to the ceiling 8, screws 20 are rotated causing fastening members 10 to descend into contact with the ceiling 8 as shown in FIG. 4. When all the fastening members have been lowered into contact with the ceiling, the ceiling will be firmly clamped between fastening members 10 and flange 6 and installation is complete.

Optionally, a flat ring or collar (not shown) may be placed on the upper surface of the ceiling, surrounding hole 9 such that when screws 20 are rotated to lower the fastening members 10, the fastening members 10 are lowered into contact with the collar rather than with the ceiling itself. Such a collar may be advantageously employed where the ceiling is damaged, particularly thin or otherwise weakened. The collar is preferably made out of a material which can be bent or hinged to allow insertion of the collar through hole 9, since the diameter of the collar will necessarily be greater than the diameter of hole 9. Additionally, the lower end of fastening members 10 may optionally have teeth or be serrated to better grip the inner surface of the ceiling.

To remove the fixture, one need simply rotate screws 20 in the opposite direction thereby increasing the distance between the lower end of fastening members 10 and flange 6. The effect of such rotation will be that the flange of the fixture drops away from the ceiling 8. By pulling the screws 20 toward the center of the housing 5, the fastening members 10 will be placed in the retracted position and the fixture may be then removed from hole 9.

While preferred embodiments of the invention have been shown and described, it will be apparent to those skilled in the art that changes and modifications may be made therein without departing from the scope or spirit of the invention in its broadest aspects.

I claim:

1. Apparatus for mounting a recessed electrical fixture to a support member, the fixture including a housing having a slot formed therein, an open end and a flange surrounding the open end, the mounting apparatus comprising:

a fastening member which extends through the slot in the housing of the fixture such that a portion of said fastening member is located within the housing and a portion of said fastening member is located outside of the housing;

means for cooperating with the threads of a screw; said cooperating means being mounted on said portion of said fastening member located within the housing;

a screw pivotally mounted within the housing and passing through said cooperating means such that rotation of the screw causes a change in the position of the fastening member relative to the open end of the housing;

spring means for urging said portion of said fastening member located outside of the housing to extend beyond the flange of the housing.

2. The apparatus of claim. 1 further comprising retaining means for keeping said spring means in a compressed state such that said portion of said fastening means located outside of the housing does not extend beyond the flange of the housing.

3. The apparatus of claim 2 wherein the mounting system includes a plurality of fastening members and a corresponding number of cooperating means, screws and spring means.

4. The apparatus of claim 3 wherein said retaining means keeps each of said spring means in a compressed state and removal of said retaining means causes simultaneous extension of all of said fastening means beyond the flange of the housing.

5. The apparatus of claim 1 wherein said portion of said fastening member located outside of the housing includes a portion which is bent to conform with the shape of the housing.

* * * * *